United States Patent [19]

Schatka et al.

[11] 3,941,471

[45] Mar. 2, 1976

[54] ELECTROPHOTOGRAPHIC COPIER WITH SAFETY ARRANGEMENT FOR PREVENTING DAMAGE TO COPYING MATERIAL IN FIXING ARRANGEMENT DURING COPIER MALFUNCTION

[75] Inventors: Günther Schatka, Pfaffenhofen; Wilm Krüger, Puchheim-Bahnhof; Rudolf Paulus, Munich; Boris Koleff, Munich; Erich Pattis, Munich; Karl Hartwig, Unterhaching, all of Germany

[73] Assignee: AGFA-GEVAERT, A.G., Leverkusen, Germany

[22] Filed: Nov. 8, 1974

[21] Appl. No.: 522,217

[30] Foreign Application Priority Data

Nov. 12, 1973 Germany ..... 2356404

[52] U.S. Cl. ..... 355/3 R; 355/14; 355/30

[51] Int. Cl.[2] ..... G03G 15/00

[58] Field of Search ..... 355/3 R, 14, 30; 352/146; 68/209

[56] References Cited

UNITED STATES PATENTS 3,791,732 2/1974 Mihalik et al. ..... 355/3 R X 3,809,475 5/1974 Post et al. ..... 355/3 R

*Primary Examiner*—Richard A. Wintercorn

*Attorney, Agent, or Firm*—Michael J. Striker

[57] ABSTRACT

The copier includes a fixing arrangement for the heat-treatment of copying material by means of a heating device, and a blower operative for keeping the heat of the fixing arrangement away from heat-sensitive components of the copier, particularly the copying drum, by establishing a flow of cooling air travelling along a first predetermined flow path. The safety arrangement includes a diverting device activatable for diverting at least part of the flow of cooling air established by the blower away from the first flow path and into a second flow path leading through the interior of the fixing arrangement to effect cooling of the interior of the fixing arrangement. A detecting device detects copier malfunction. A control unit connected to the diverting device and to the detecting device is operative in response to detection of copier malfunction for activating the diverting device, to prevent copying material in the fixing arrangement from becoming damaged or ignited due to overheating.

10 Claims, 2 Drawing Figures

ELECTROPHOTOGRAPHIC COPIER WITH SAFETY ARRANGEMENT FOR PREVENTING DAMAGE TO COPYING MATERIAL IN FIXING ARRANGEMENT DURING COPIER MALFUNCTION

BACKGROUND OF THE INVENTION

The invention relates to an electrophotographic copier provided with a fixing apparatus for the heat treatment of copying material by means of a heating device, and further provided with a blowing device for insulating thermally sensitive parts of the copier, particularly the copier drum, from the heat in the fixing apparatus.

SUMMARY OF THE INVENTION

It is an object of the invention to provide an electrophotographic copier of the general type mentioned above so designed that in the case of copier malfunction, particularly copying material transport malfunction, damage to copying material in the fixing arrangement is prevented. For example, if an accumulation of copying material occurs in the fixing arrangement due to malfunction, and if the copying material in the fixing arrangement is subjected long enough to the high temperature there prevailing, the copying material may become ignited, in certain circumstances.

It is an object of the invention to prevent this and other such damage from occurring.

These objects, and others which will become more understandable from the description, below, of preferred embodiments, can be met, according to one advantageous concept of the invention, by so designing the copier that in the case of malfunction, particularly copying material transport malfunction, a control device is automatically activated by means of which the air stream of the blower is at least in part diverted into the interior of the fixing arrangement.

An important advantage of this expedient is that the blower which is utilized, in the event of copier malfunction, to cool the interior of the fixing arrangement and thereby prevent damage to or actual ignition of the copying material therein, is the same blower anyway provided in the copier for the purpose of keeping the heat of the fixing arrangement away from the heat-sensitive parts of the copier, particularly the copying drum, during normal operation of the copier. The inventive expedient accordingly constitutes a particularly simple and ingenious way of preventing excessive heating of the copying material in the fixing arrangement and of avoiding the concomitant danger of fire.

According to a further concept of the invention, the fixing arrangement has an opening into which cooling air from the blower is automatically blown, in the case of malfunction, and the air-diverting arrangement includes a flap which normally closes off this opening. In particular, the flap is provided with a biasing spring which tends to move the flap into the position unblocking the opening into the fixing arrangement. However, this biasing force, during normal operation of the copier, is opposed by the force of a holding arrangement which maintains the flap in the position closing off the fixing arrangement opening. When copier malfunction is detected, the holding arrangement releases the flap, and air is blown into the fixing arrangement. The control device which causes the hc!ding arrangement to release the flap can, for example, be operative for detecting the transport velocity of copying material.

According to a further advantageous concept of the invention, the holding arrangement includes an electromagnet, and the control device which cooperates with the electromagnet includes a comparator which compares a voltage corresponding to a preselected value against a generated voltage having a magnitude proportional to the speed of travel of the copying material.

Advantageously, the generator producing the speed-indicating signal is comprised of an operational amplifier provided with a feedback branch which includes a capacitor, with a controllable electronic switch being connected in parallel with such capacitor, as well as a pulse generating device driven by and accordingly synchronized with the means for effecting transport of the copying material. The comparator is advantageously designed as a threshold circuit, for example a Schmitt trigger circuit.

In order to guarantee sufficient cooling of the copying material in the fixing arrangement in the event that the malfunction of the copier involves loss of energizing current, it is contemplated, according to one advantageous concept of the invention, to provide the blower arrangement with a heavy mass, preferably in the form of a flywheel, so that the inertia of the blower flywheel will cause the blower to produce a flow of cooling air for a considerable period of time even after energizing voltage is no longer being supplied to the blower motor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
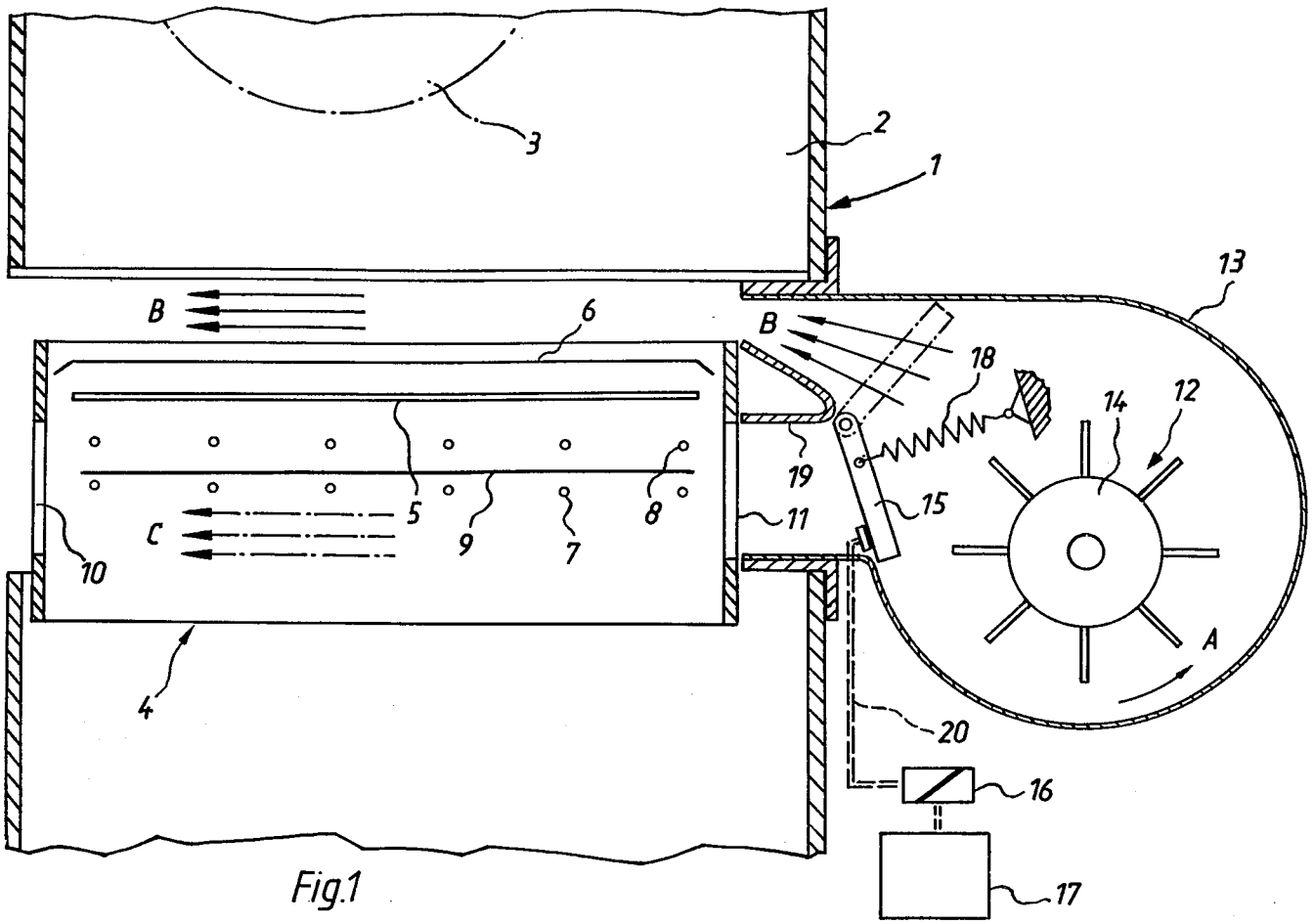
FIG. 1 is a schematic depiction of part of an electrophotographic copier.

In FIG. 1, reference numeral 1 generally designates a copier comprised of a housing section 2 containing a copying drum 3. A fixing arrangement 4 is comprised of a heating device 5, a heat reflector 6, guide rods 7 and 8 and copying paper 9. The housing of the fixing arrangement 4 has openings 10 and 11.

A blower 12 is provided in a housing 13. The blower 12, comprised in this embodiment of a rotary air impeller, is provided with a flywheel 14.

The opening 11 of the housing of the fixing arrangement 4 is normally closed by a pivotable flap member 15. Normally, flap member 15 is held in the solid-line position by means of an electromagnet 16 which is in turn controlled by a control device 17. The flap member 15 is biased by a schematically depicted biasing spring 18 towards the position thereof shown in FIG. 1 in dash-dot lines. It will be understood that the biasing spring for the flap member 15 need not have the shape and disposition illustrated, and can instead be a torsion spring mounted on the pivot axle of the flap member 15, for example. Reference numeral 19 designates a profiled member made of sheet material.

During normal operation of the copier 1, the opening 11 in the housing of the fixing arrangement 4 is closed by the flap member 15, so that the blower 12, rotating in the direction of arrow A, creates a stream of cooling air which is conveyed in the direction of the arrows B through the space between the housing section 2 and the fixing arrangement 4. In this way, the heat of the fixing arrangement 4 is kept away from the heat-sensitive components in the housing section 2, particularly the copying drum 3.

In the event that the copier malfunctions, in this embodiment in the event there is a malfunction in the transport of the copying paper in the fixing arrangement 4, the electromagnet 16 is deenergized by the control device 17 and, via the magnetic connection 20, the flap 15 is released. As a result, the flap, under the force of its biasing spring 18, moves into the position thereof shown in dash-dot lines. The stream of cooling air established by the blower now travels into the opening 11 of the fixing arrangement 4 and travels through the interior of the fixing arrangement 4 in the direction indicated by the arrows C. This air is warmed as it travels through the fixing arrangement 4 and is exhausted to the ambient atmosphere through the opening 10 in the housing of the fixing arrangement 4.

Figure 2:
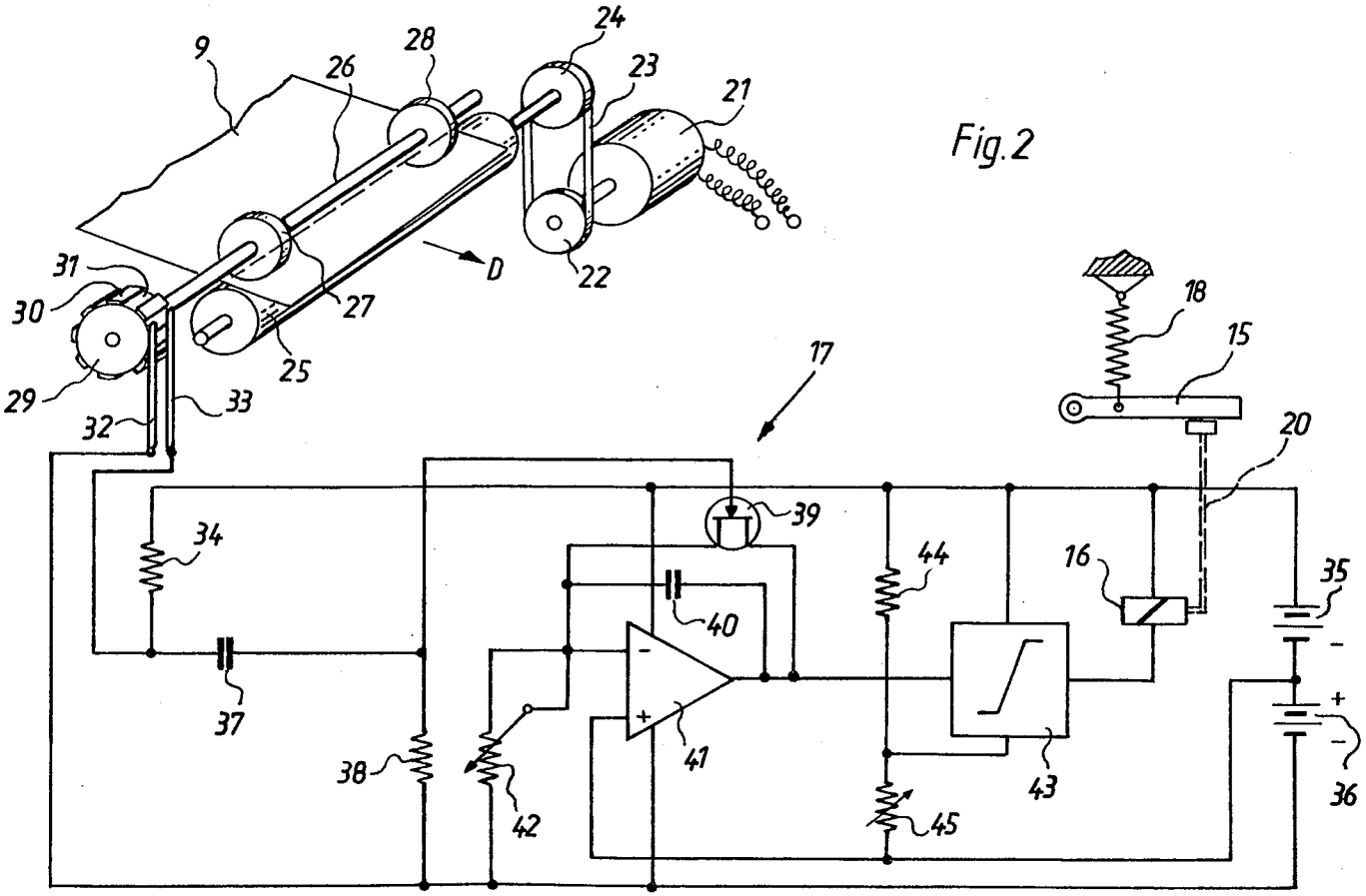
FIG. 2 is a diagram of a circuit for detecting the transport speed of copying material and for controlling the flow of cooling air in dependence thereon.

FIG. 2 depicts the circuitry of the control device 17, and its connection to different parts of the copier 1.

An electric motor 21 is connected by means of a belt-drive coupling 22, 23, 24 to a drive roller 25. Arranged above drive roller 25 is a shaft 26 provided with rollers 27 and 28. The rollers 27, 28 press the copying paper 9 against the drive roller 25. Mounted on one end of shaft 26 is an impulse contact disk 29, provided around its circumference with electrically conductive portions 30 alternating with electrically non-conductive portions 31. The impulse contact disk 29 cooperates with two springy contacts 32, 33 which ride on the surface of the rotating impulse contact disk 29. The contacts 32, 33, together with the conductive portions 31 of the disk 29, form a switch connected in series with resistor 34. This series connection is connected in parallel to two batteries 35, 36. Connected across the switch 32, 33 is a differentiating stage comprised of a capacitor 37 and a resistor 38.

The output of this differentiating stage 37, 38 is connected to the gate electrode of a field-effect transistor 39, the source-drain current path of which is connected in parallel to an integrating capacitor 40. This capacitor 40 is connected in the feedback branch of an operational amplifier 41. An adjustable resistor 42 connects the inverting input of operational amplifier 41 to the negative terminal of battery 36. The output of operational amplifier 41 is connected to the input of a threshold detector circuit 43 (e.g., an adjustable Schmitt trigger), the threshold voltage of which is adjustable by means of the adjustable voltage divider 44, 45. Connected in the output circuit of the threshold detector 43 is the electromagnet 16 mentioned above. The circuit 43 is so designed that if the input voltage applied to it is below the preselected threshold voltage the electromagnet 16 is energized, whereas if the input voltage applied to circuit 43 is higher than the preselected threshold voltage the electromagnet 16 is deenergized.

The copying paper 9, transported in the direction indicated by arrow D, turns the shaft 26 with a rotary speed corresponding to the transport speed of the paper. Accordingly, the switch constituted by spring contacts 32, 33 is alternately opened and closed with a frequency proportional to the paper transport speed. The voltage jumps appearing at the junction of components 34 and 37 are differentiated by the differentiator 37, 38 so that alternately negative and positive voltage impulses are applied to the gate electrode of FET 39. When no voltage impulse is applied to the gate electrode of FET 39, the gate electrode of FET 39 is in effect connected to the negative terminal of battery 36, via resistor 38, and accordingly the transistor 39 is non-conductive. Only when, via the differentiator 37, 38, a positive voltage impulse is applied to the gate electrode of FET 39 does the FET become briefly conductive. During the time FET 39 conducts, a sawtooth voltage is generated at the output of operational amplifier 41, the peak value of which, in the case of proper transport of the copying paper 9, is lower than the threshold voltage of circuit 43. Accordingly, if the transport speed of the copying paper 9 is at the normal value, the electromagnet 16 remains energized, and the flap 15 is held by the magnet 16, against the opposing force of spring 18, in the position shown in solid lines in FIG. 1.

If now the transport speed of the copying paper 9 markedly decreases, then the peak value of the sawtooth voltage waveform generated at the output of operational amplifier 41 will exceed the threshold voltage of circuit 43. As a result, electromagnet 16 will become deenergized and the flap 15 will be released. The flap 15 will be pivoted by the force of schematically depicted spring 18 into the position shown in dash-dot lines in FIG. 1. As a result, the stream of cooling air from the blower 12 will enter fixing arrangement 4 through opening 11 and will travel through the fixing arrangement 4 in the direction of the arrows C. Accordingly, a reliable cooling of the contents of fixing arrangement 4, in particular the copying paper therein, will be automatically achieved.

If the copier malfunction involves loss of the supply voltage, this will likewise result in deenergization of the electromagnet 16 and swinging of the flap 15 from the solid-line position of FIG. 1 to the dash-dot-line position of FIG. 1. Although the motor of blower 12 will likewise have become deenergized, the provision of the flywheel 14 will assure that the blower 12 will continue to rotate for a considerable time, sufficient to effect a significant degree of cooling of the interior of fixing arrangement 4.

It will be understood that each of the elements described above, or two or more together, may also find a useful application in other types of circuits and constructions differing from the types described above.

While the invention has been illustrated and described as embodied in a copying device in which means are provided for cooling the interior of the fixing arrangement in response to improper changes of copying paper transport speed, it is not intended to be limited to the details shown, since various modifications and structural changes may be made without departing in any way from the spirit of the present invention.

In particular, it is noted that the malfunction which triggers the cooling of the fixing arrangement need not be an improper change in copying material transport speed and/or need not be detected by the specific means illustrated herein. Other known forms of malfunction which could result in damage to the contents of the fixing arrangement due to overheating, and/or other known methods of detecting such forms of malfunction fall within the spirit and scope of the invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention.

What is claimed as new and desired to be protected by Letters Patent is set forth in the appended claims.

1. In an electrophotographic copier of the type comprised of a fixing arrangement for the heat-treatment of copying material by means of a heating device and a blower operative for keeping the heat of said fixing arrangement away from heat-sensitive components of the copier, in particular the copying drum, by establishing a flow of cooling air travelling along a first predetermined flow path, a safety arrangement comprising, in combination, diverting means activatable for diverting at least part of the flow of cooling air established by said blower away from said first flow path and into a second flow path leading through the interior of said fixing arrangement to effect cooling of the interior of said fixing arrangement; detecting means for detecting copier malfunction; and control means connected to said diverting means and said detecting means and operative in response to detection by said detecting means of copier malfunction for activating said diverting means.

2. The safety arrangement defined in claim 1, wherein said diverting means comprises means blocking said second path when said diverting means is unactivated and unblocking said second path when said diverting means is activated.

3. The safety arrangement defined in claim 1, wherein said fixing arrangement is provided with an opening for the entrance of cooling air from said blower into the interior of said fixing arrangement, and wherein said diverting means comprises a flap movable between a first position blocking said opening and a second position unblocking said opening, biasing spring means operative for tending to move said flap to said second position, and holding means operative for holding said flap in said first position when said diverting means is unactivated and for releasing said flap when said diverting means is activated to permit said biasing spring means to move said flap to said second position.

4. The safety arrangement defined in claim 3, the copier including transporting means for transporting copying material through said fixing arrangement, and wherein said holding means is an electromagnetic holding means, and wherein said control means includes means operative for detecting when the transport speed of said transport means falls below a preselected value and in response to such detection activating said diverting means.

5. The safety arrangement defined in claim 3, the copier including transporting means for transporting copying material through said fixing arrangement, and wherein said holding means is an electromagnetic holding means, and wherein said control means includes detecting means operative for detecting when the transport speed of said transport means falls below a preselected value and in response to such detection deenergizing said electromagnetic holding means.

6. The safety arrangement defined in claim 5, wherein said detecting means includes means for generating a first signal indicative of said preselected value and a second signal indicative of the transport speed of said transport means, and comparator means operative for comparing said first and second signals to determine when said transport speed falls below said preselected value.

7. The safety arrangement defined in claim 6, wherein said means for generating said second signal includes an energy-storing timing stage and means for effecting alternate opposite changes of the energy stored by said energy-storing timing stage in dependence upon said transport speed.

8. The safety arrangement defined in claim 6, wherein said means for generating said second signal comprises means for generating a train of pulses having a pulse repetition frequency proportional to the transport speed of said transporting means, a sawtooth-voltage generator comprised of an operational amplifier having a feedback branch including an integrating capacitor and a controllable electronic switch connected across said integrating capacitor for discharging the latter, and wherein said electronic switch has a control input connected to receive said train of pulses and be rendered conductive by successive ones of said pulses, whereby there will appear at the output of said operational amplifier a sawtooth voltage waveform having peak values proportional to said transport speed, and a threshold detecting circuit having an input connected to the output of said operational amplifier for receiving said sawtooth voltage waveform and having an output connected to said electromagnetic holding means and operative for deenergizing the latter when the transport speed indicated by the peak value of the sawtooth voltage waveform falls below a preselected value.

9. The safety arrangement defined in claim 1, wherein said blower is a rotary, electrically energized blower, and wherein said control means comprises electrically energized means for normally maintaining said diverting means unactivated but operative when electrically deenergized for activating said diverting means, and further including a flywheel coupled to said rotary, electrically energized blower, whereby in the event of loss of energizing current of said electrically energized means and of said blower said blower will continue to operate until the kinetic energy stored in said flywheel is dissipated and said diverting means will become activated to cause the stream of air created by said blower to be diverted into the interior of said fixing arrangement.

10. In an electrophotographic copier comprised of a first section and a second section, blower means operative for keeping the heat of said first section away from said second section by establishing a flow of cooling air travelling along a first predetermined flow path; diverting means activatable for diverting the flow of cooling air established by said blower means away from said first flow path and into a second flow path leading through the interior of said second section to effect cooling thereof; detecting means for detecting copier malfunction; and control means connected to both said diverting means and said detecting means and operative in response to detection by said detecting means of copier malfunction for activating said diverting means.

* * * * *